United States Patent [19]

Kamei et al.

[11] Patent Number: 4,638,778

[45] Date of Patent: Jan. 27, 1987

[54] IDLE SPEED CONTROL APPARATUS FOR INTERNAL COMBUSTION ENGINE

[75] Inventors: Eiichi Kamei, Nagoya; Hideaki Namba, Oobu, both of Japan

[73] Assignee: Nippondenso Co., Ltd., Kariya, Japan

[21] Appl. No.: 830,935

[22] Filed: Feb. 19, 1986

[30] Foreign Application Priority Data

Feb. 19, 1985 [JP] Japan ..... 60-31265

[51] Int. Cl.[4] ..... F02D 11/10

[52] U.S. Cl. ..... 123/339; 123/436

[58] Field of Search ..... 123/339, 486, 480, 436, 123/419

[56] References Cited

U.S. PATENT DOCUMENTS

| | | | |
|---|---|---|---|
| 4,432,322 | 2/1984 | Inoue | 123/486 |
| 4,475,506 | 10/1984 | Riordan | 123/438 |
| 4,513,713 | 4/1985 | Koumura | 123/339 |
| 4,550,701 | 11/1985 | Suzuki | 123/436 |
| 4,562,814 | 1/1986 | Abo | 123/486 |

*Primary Examiner*—Ronald B. Cox

*Attorney, Agent, or Firm*—Cushman, Darby & Cushman

[57] ABSTRACT

Apparatus for controlling idle speed of an internal combustion engine (M1) equipped with fuel injection valves (M2) comprises a throttle actuator (M4) associated with a throttle valve (M3), engine speed detecting unit (M5), intake air quantity detecting unit (M6), and electronic control unit (M8) for controlling the fuel injection valves (M2) and the throttle actuator (M4). The electronic control unit (M8) comprises a target idle speed setting unit (M9), a target intake air quantity setting unit (M10), and an integral-added optimal regulator (M11) for determining feedback amounts respectively in connection with the amount of fuel to be injected and the opening degree of the fuel injection valves. In such apparatus, target intake air quantity is determined as a value which makes fuel supply amount minimum on the basis of correlation between intake air quantity and fuel supply amount when the target idle speed is made constant. The integral-added optimal regulator determines the amount of feedback on the basis of an optimal feedback gain predetermined according to the dynamic model of the system relating to the operation of the internal combustion engine. As a result, the rotational speed of the internal combustion engine is controlled to a target idle speed with high response and stability characteristic.

2 Claims, 9 Drawing Figures

IDLE SPEED CONTROL APPARATUS FOR INTERNAL COMBUSTION ENGINE

BACKGROUND OF THE INVENTION

1. Field of the Invention

This invention relates generally to apparatus for controlling an internal combustion engine, and particularly to such apparatus for controlling idle speed to a target or desired value.

2. Prior Art

According to a conventional idle speed control apparatus for an internal combustion engine, as disclosed in Japanese patent application provisional publication No. 54-76723, engine speed is detected, and flow rate of air passing through a by-pass of a throttle valve is controlled so that the deviation of the detected idle speed of the engine from a target idle speed is made zero.

However, such conventional idle speed control apparatus suffers from a problem that a desired follow-up control is difficult when a target idle speed is increased or decreased at the time of turning on and off an air-conditioner of a motor vehicle. Therefore, it is difficult to ensure sufficient output of an internal combustion engine when it is intended to reduce fuel consumption amount due to contradiction.

SUMMARY OF THE INVENTION

The present invention has been developed in order to remove the above-described drawbacks inherent to the conventional apparatus for controlling idle speed of an internal combustion engine.

It is, therefore, an object of the present invention to provide a new and useful idle speed control apparatus with which fuel consumption amount is reduced while sufficient output is ensured with desirable follow-up characteristic such that the engine is operated with intake air quantity causing minimal fuel consumtion.

According to a feature of the present invention a target intake air quantity is determined as a value which makes fuel supply amount minimum on the basis of correlation between intake air quantity and fuel supply amount when the target idle speed is made constant, while control means is constructed as an integral-added optimal regulator which determines the amount of feedback on the basis of an optimal feedback gain predetermined according to the dynamic model of the system relating to the operation of the internal combustion engine. As a result, the rotational speed of the internal combustion engine is controlled to a target idle speed with desirable response and stability characteristic.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
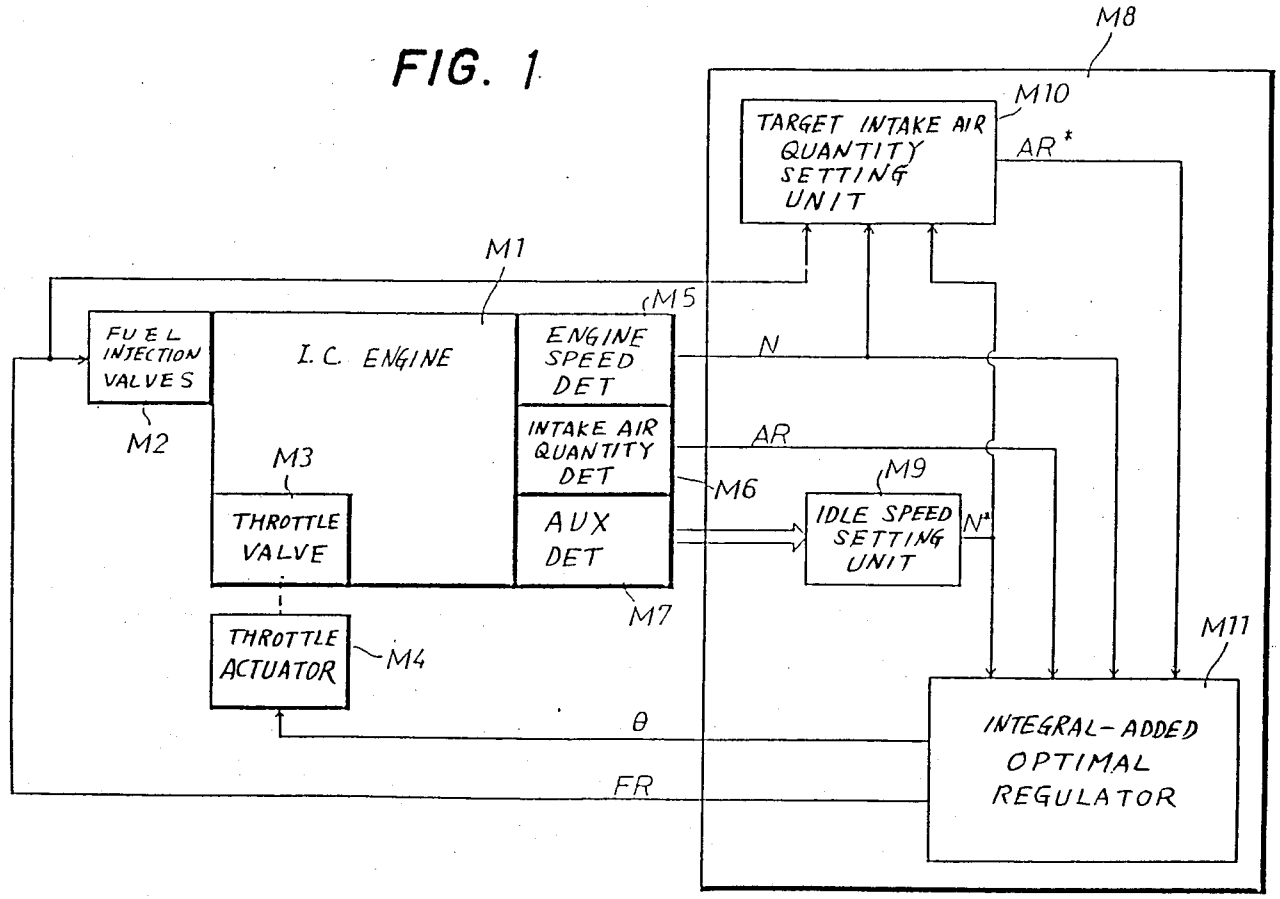
FIG. 1 is a schematic diagram showing basic structure of the present invention.

Referring now to FIG. 1, a schematic diagram is shown for describing basic structure of the present invention. As a controlled object, an internal combustion engine M1 is used. The throttle valve M3 of the engine M1 is responsive to a throttle actuator M4 which is responsive to a signal $\theta$ from an integral-added optimal regulator M10 described hereinlater. The engine M1 is equipped with one or more fuel injection valves M2, an engine rotational speed detecting means or unit M5, an intake airflow rate or air quantity detecting means or unit M6, and auxiliary detecting means or unit M7. The combination of the fuel injection valve M2, the throttle valve M3 and the throttle actuator M4 is referred to as an air-fuel mixture supply means or unit. The control system of FIG. 1 further comprises a target intake airflow setting means or unit M10 and an idle speed setting means or unit M9. The above-mentioned various means or units are mutually related to form apparatus for controlling vehicle speed such that the apparatus comprises: a throttle actuator M4 for adjusting opening degree of a throttle valve M3 disposed in an intake pipe of the engine M1 equipped with one or more fuel injection valves M3; engine speed detecting means M5 for producing a first signal indicative of the rotational speed of the engine; intake air quantity detecting means M6 for producing a second signal indicative of the intake air quantity sucked by the engine; an electronic control means M8 responsive to the first and second signals for producing and supplying fuel injection valve drive signals to the fuel injection valves M2 and for producing and supplying throttle actuator drive signal to the throttle actuator M4, the electronic control means M8 having a target idle speed setting unit M9, the electronic control means M8 also having: a target intake air quantity setting unit M10 for determining an intake air quantity corresponding to minimum fuel amount with which the rotational speed of the engine can be maintained at the target idle speed, on the basis of fuel injection amount-intake air quantity correlation pattern which is predetermined in correspondence with the target engine speed in receipt of the target idle speed; and an integral-added optimal regulator M11 for determining feedback amounts respectively in connection with the amount of fuel to be injected and the opening degree of the fuel injection valves on the basis of predetermined operating formulas used for estimating the internal state of the engine which formulas are determined in accordance with dynamic model of system relating to the operation of the engine, and an optimal feedback gain, and for outputting the fuel injection valve drive signals and the throttle actuator drive signals which are produced acccording to the feedback amounts now determined.

The above-mentioned idle speed setting unit M9 is arranged to set a target or desired idle speed in response to various signals from an idle switch, an engine coolant temperature sensor, a vehicle speed sensor, air-conditioner switch, and so on which are included in the auxiliary detecting unit M7, in accordance with the coolant temperature and on and off states of the air-conditioner only when whe idle switch is in on state and the vehicle speed is below a predetermined value which is close to zero.

Figure 2:
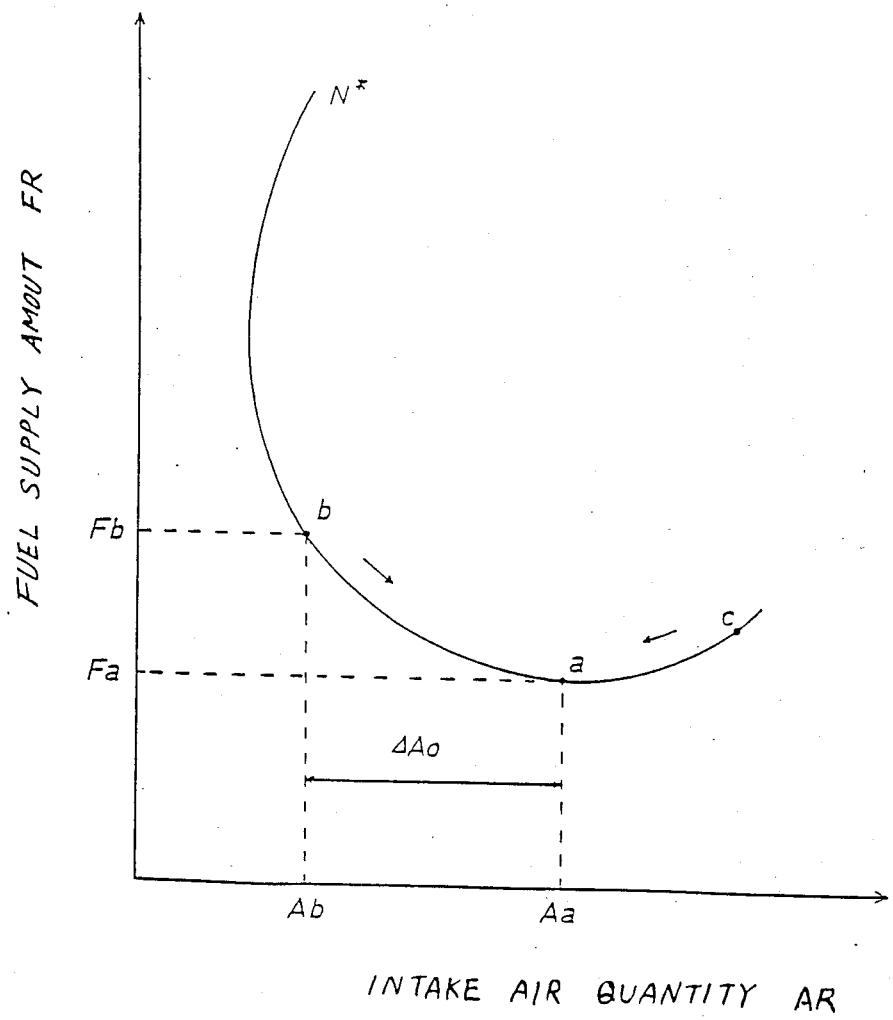
FIG. 2 is a constnat idle speed diagram showing the relationship between fuel amount and intake air quantity of an internal combustion engine of an automobile.

The target intake air quantity setting unit M10 sets an initial air quantity which renders fuel supply amount minimum maintaining a given target idle speed as follows:

FIG. 2 is a constant engine speed diagram showing the relationship between intake air quantity AR and fuel supply amount FR when a target idle speed N* of the internal combustion engine M1 is made constant. Assuming that the internal combustion engine M1 is operated at point "b", i.e. an intake air quantity of Ab and fuel supply amount of Fb, at a target idle speed equals N*, it will be understood that the fuel supply amount Fa becomes minimum at a point (Aa, Fa) where the intake air quantity has been incremented by ΔAo from that at point "b". The target intake air quantity setting unit M10 is constructed to set the target intake air quanitity AR* so that the fuel supply amount FR is made minimum when maintaining the target idle speed N*, and may be realized generally by a control performed by a microcomputer or the like as a part of an electronic control means or unit M8 which will be described hereinlater.

The electronic control means M8 is realized by an electronic circuit constructed using a microprocessor together with a ROM, a RAM, peripheral units and input/output circuits, and is arranged to control the internal combustion engine M1 using feedback amount determined by optimal feedback gain determined by dynamic models of the system relating to the operation of the internal combustion engine M1 so that the operating state approaches a target with the target set, the target intake air quantity setting unit M10 and variables of engine operating states set by the idle speed setting unit M9 being respectively known. Namely, the electronic control means M8 is constructed as an integral-added optimal regulator which determines optimal amount of feedback from the variables of the operating state of the internal combustion engine Ml and the target intake air quantity set by the target intake air quantity setting unit M10.

A method of constituting such integral-added optimal regulator is described in detail in documents, such as "Linear System Control Theory" written by Katsuhisa FURUTA published by Shokodo Japan in 1976. An outlook for the method of actual forming of such regulator will be given hereinbelow. In the following description, the references F, X, A, B, C, y, u, L, G, Q, R, T, P indicate vectors (matrix), a superscript $^T$ such as $A^T$ indicating transposed matrix, a superscript $^{-1}$ such as $A^{-1}$ indicating inverse matrix, a symbol ‾ such as $\bar{X}$ indicating an estimate, a symbol such as $\bar{C}$ indicating an amount handled by another system, i.e. a state observer (which will be simply referred to as observer hereinafter) which amount is generated by way of transform or the like from the system which is a controlled object, a symbol * such as y* indicating a target value respectively.

It is known in modern control theory that in a control of a controlled object, i.e. the control of the internal combustion engine M1 in this case, the dynamic behavior of the controlled object is described in discrete-time system as:

$$X(k)=A\cdot X(k-1)+B\cdot u(k-1) \quad (1)$$

$$y(k)=C\cdot X(k) \quad (2)$$

The above Eq. (1) is called a state equation, and Eq. (2) is called an output equation, and a term X (k) indicates state variables which represent the internal state of the internal combustion engine M1, a term u (k) indicates vectors comprising variables indicative of condition of operation of the internal combustion engine M1, and a term y (k) indicates vectors comprising variables representing the operating state of the internal combustion engine M1. The Eqs. (1) and (2) are both described in discrete-time system, and a subscript "k" indicates that the value is of the present time, while a subscript "k−1" indicates that the value is of an instant which is one sampling cycle before the present time.

The state variables X (k) indicating the internal state of the internal combustion engine M1 represents information relating to the history of the system which is necessary and sufficient for predicting the influence in future in the control system. Therefore, the dynamic model of the system relating to the operation of the internal combustion engine M1 will be clear, and if we can determine vectors A, B and C of Eqs. (1) and (2), then it is possible to optimally control the operation of the internal combustion engine using the state variables X (k). In a servo system, while the system has to be expanded, this will be described hereinlater.

It is difficult to accurately theoretically obtain dynamic models of a complex objective such as an internal combustion engine M1, and therefore, it is necessary to obtain the same through experiments. This is a method of constructing a model, which method is so called system identification, and in the case that internal combustion engine M1 is operated under a given state, the model is constructed according to state equation (1) and output equation (2) with which linear approximation is satisfied around the given state. Therefore, even in the case that the dynamic model related to the operation of the internal combustion engine M1 is of nonlinear, linear approximation can be performed by dividing the operating range into a plurality of normal operating states, and therefore it is possible to determine each dynamic model. As a result it is possible to widen the operating range where models can be applied.

If the controlled object is of a sort that a physical model can be relatively easily constructed, then the model (i.e. vectors A, B, and C ) of a dynamic system can be determined through system identification which can be made through a method such as frequency response method or spectrum analysis. However, in the case of controlled object of multivariable system, such as the internal combustion engine M1, it is difficult to make a physical model which is accurately approximated, and in such a case, dynamic model is constructed through least square method, instrumental variable method or on-line identification.

Once a dynamic model is determined, an amount of feedback is determined from the state variables X (x), the variables y(k) of the operating state and its target value y*(k), so that controlled variables u (k) of the condition of operation are theoretically and optimally determined. In an internal combustion engine M1 or the like, as variables directly influencing on the operation of the internal combustion engine M1, such as air amount actually sucked and the dynamic behaviour of combustion, or fuel amount within the mixture related to combustion, output torque of the internal combustion engine, may be treated as the state variables X (k). However, most of such variables are difficult to be directly measured. Therefore, means called state observer (observer) is formed within the electronic control means M8 so that it is possible to estimate the state variables X (k) of the internal combustion engine M1 using values of the variables of the condition of operation of the internal combustion engine M1 and the variables of the operating state. This is the observer according to modern control theory, and various types of observer and their designing methods are known. These are described in detail, for instance, in "Mechanical System Control" written by Katsuhisa Furuta, published from Ohm Co. Ltd. in 1984, and the observer may be designed as a minimal order obsersver or a finite time settling observer in correspondence with the fashion of an applied controlled object, i.e. the internal combustion engine M1 and apparatus for controlling the operating state thereof.

The electronic control means M8 controls the fuel injection valves M2 and the throttle actuator M4, in a system expanded using measured state variables or state variables X (k) estimated by the above-mentioned observer and an accumulated value obtained by accumulating the difference between a target intake air quantity set by the target intake air quantity setting unit M10 and an actual intake air quantity and also the difference between the target idle speed set by the idle speed setting unit M9 and the actual engine rotational speed of the internal combustion engine M1, by determining an optimal feedback amount using both the measured or estimated state variables and the accumulated values and also a predetermined optimal feedback gain. The accumulated value is a value which is necessary since the target value of the operating state varies depending on the amount of demand to the internal combustion engine M1. In a control of a servo system, it is required generally to perform a control for cancelling steady-state error between the target value and an actual controlled variable, and this corresponds to the necessity of inclusion of $1/S^l$ (integration of $l^{th}$ order) in a transfer function. In the case that a state equation is made with the transfer function of the sytem being determined through system identification as described in the above, it is preferable to include such integrated amount in view of stability against noise. In the present invention, $l=1$, namely, integration of first order may be considered. Therefore, when the accumulated value is introduced into the above-mentioned state variable X (k) to expand the system so as to determine the feedback amount from these values and a predetermined optimal feedback gain F, the control input to the controlled object, i.e. the variables of the condition of operation of the internal combustion engine M1, are determined as an integral-added optimal regulator.

Nextly, it will be described in connection with optimal feedback gain. In an optimal regulator to which an integral element is added as described in the above, the way of finding a control input (the variables of the condition of operation of the internal combustion engine M1 in this case) which minimizes a performance index J is made clear, while it is also known that the optimal feedback gain can be obtained from a solution of Riccati equation, A, B, C matrixes of the state equation (1) and the output equation (2), and the weighted parameter used in performance index (see the above-mentioned book). In the above, the weighted parameter is initially arbitrarily given so as to change the weighting in the regulation, by the performance index J, of the behavior of the variables of the condition of operation of the internal combustion engine M1. It is possible to determine an optimal value through repetition of simulation by changing the weighted parameter by a given amount from the behavior of the operating state variables which are obtained as the result of siumulation performed by a large computer with an arbitrary weighted parameter being given. As a result, an optimal feedback gain F is also determined.

Therefore, the electronic control means M8 in the apparatus for controloling an internal combustion engine according to the present invention is formed as an integral-added optimal regulator M11 using a dynamic model of the internal combustion engine M1 which dynamic model is determined in advance through system identification, and the parameter of the observer therein and an optimal feedback gain F and so on are determined in advance through simulation using the internal combustion engine M1.

While it has been described that the state variable X (k) is an amount indicating the internal state of the internal combustion engine M1, this is not required to be a variable corresponding to actual physical amount, and therefore, this may be designed as a vector of an appropriate order which is suitable for indicating the sate of the internal combustion engine M1.

The apparatus for controlling an internal combustion engine according to the present invention having the above-described structure operates such that target intake air quantity and target idle speed are computed by the target intake air quantity stting unit M10 and the idle speed setting unit M9 respectively, and an optimal feed back gain is obtained so that variables of the internal combustion engine M1 are equal to the above-mentioned target values by the integral-added optimal regulator M11 to control the fuel injection valves M2 as well as the throttle actuator M4. Furthermore, since the target intake air quantity setting unit M10 operates to compute target intake air quantity so that the fuel consumption amount becomes minimum under a condition that the idle speed of the internal combustion engine is constant, the apparatus for controlling an internal combustion engine according to the present invention optimally controls the internal combustion engine M1 to obtain an oprating state where fuel consumption amount is minimum with the target idle speed.

Figure 3:
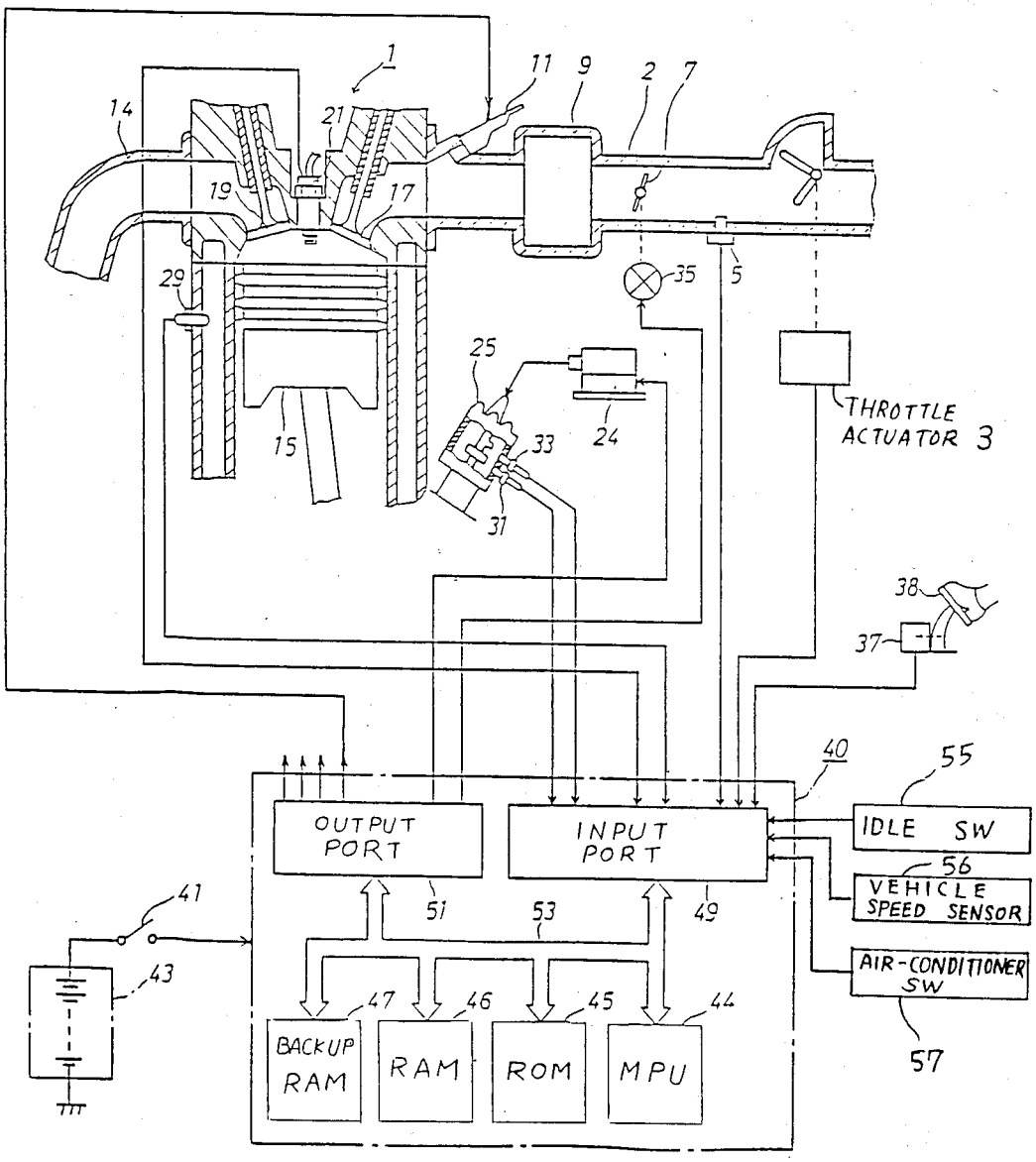
FIG. 3 is a schematic diagram showing an internal combustion engine and its peripheral elements as an embodiment of the present invention.
Figure 4:
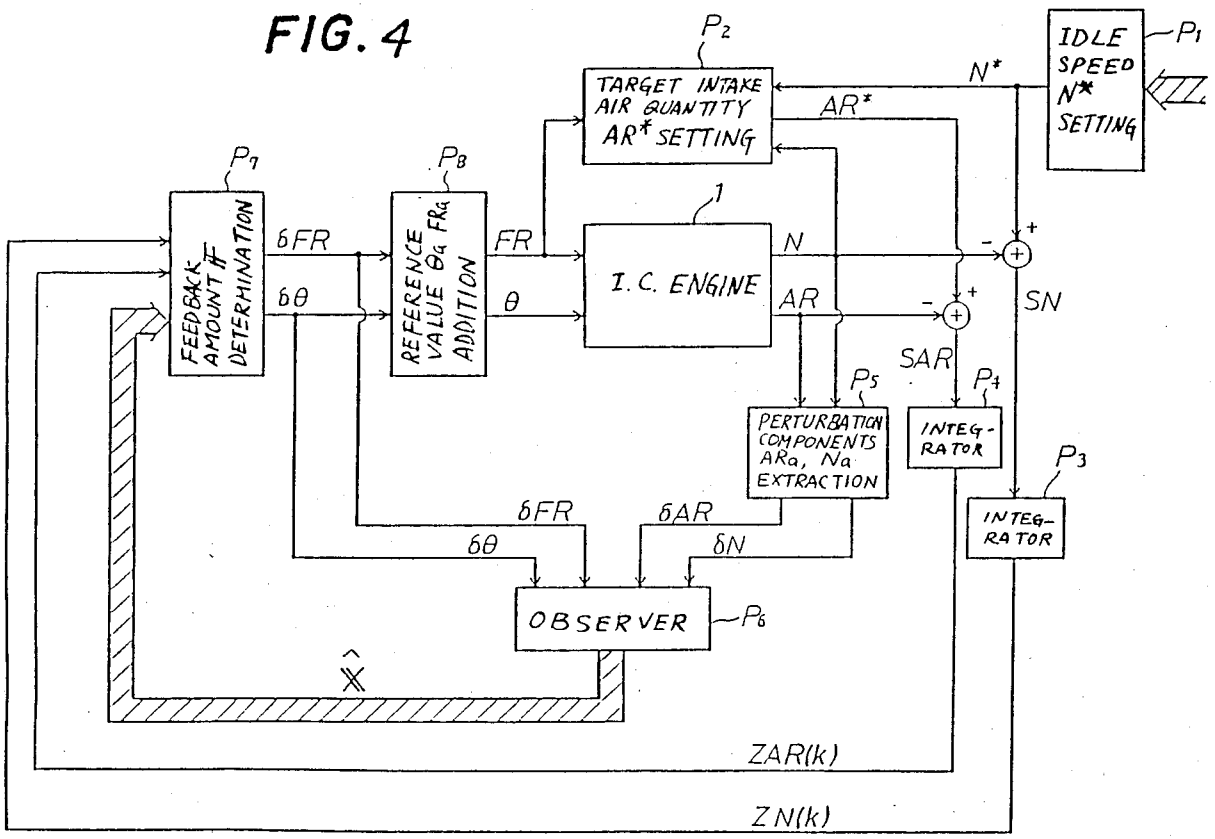
FIG. 4 is a diagram of a control system of the embodiment of FIG. 3.
Figure 5:
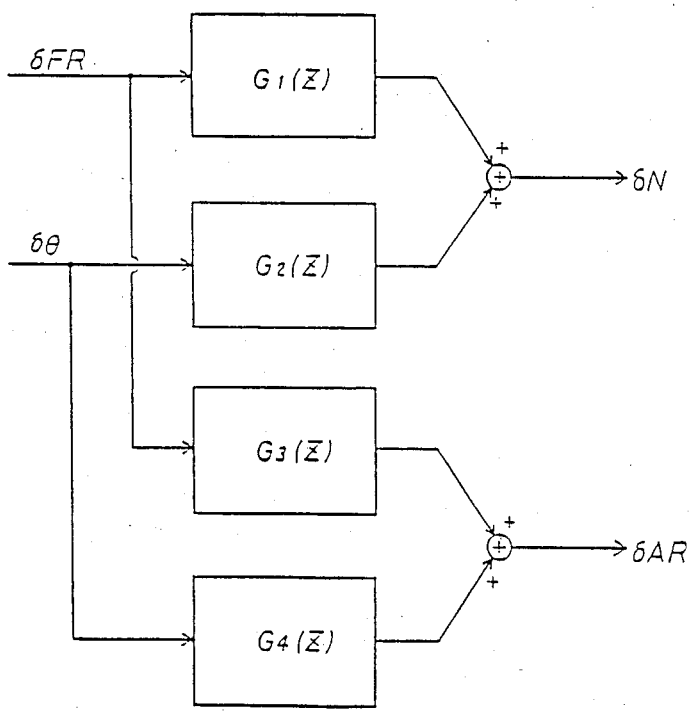
FIG. 5 is a block diagram used for identifying a model of the system of the embodiment of FIGS. 3 and 4.
Figure 7:
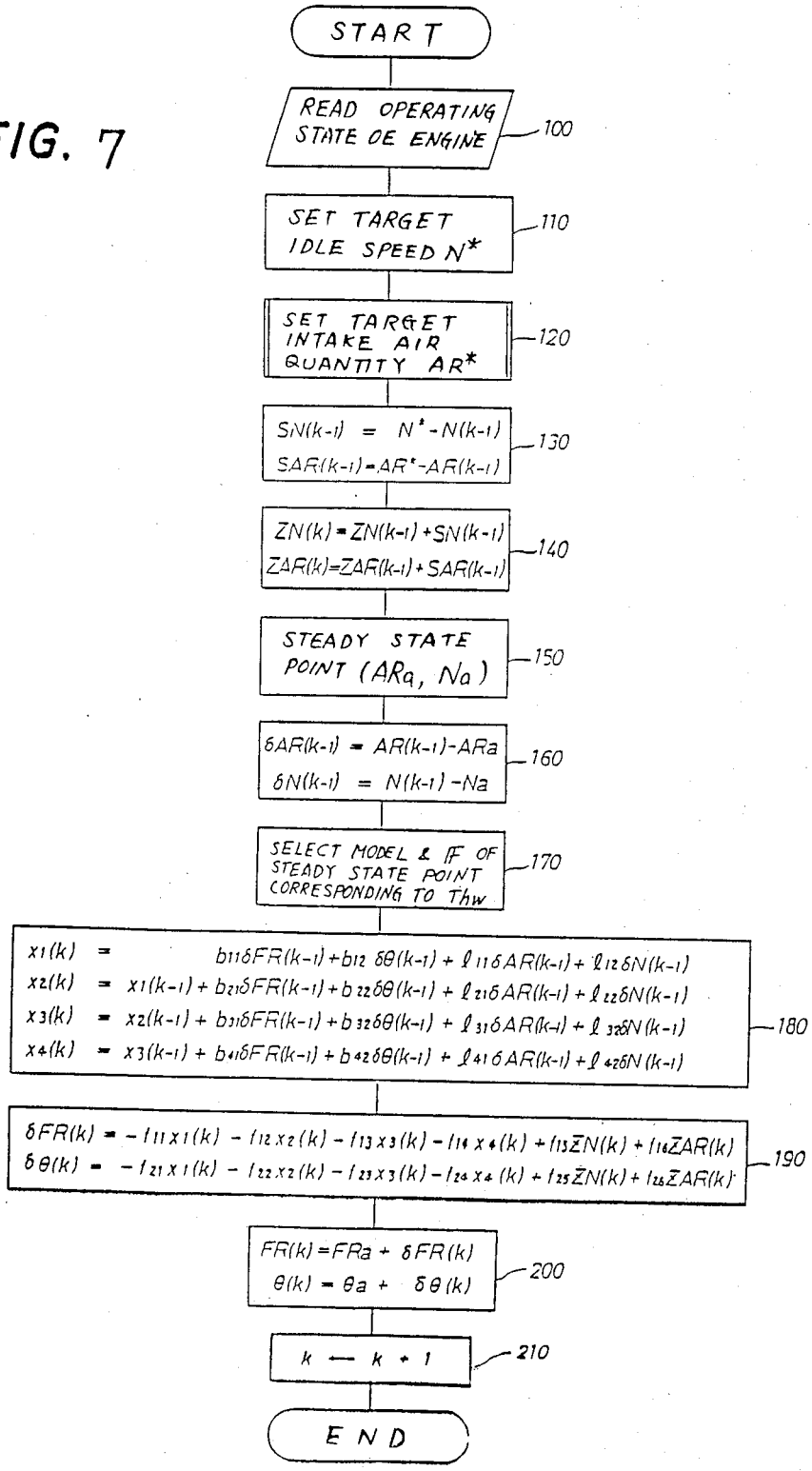
FIG. 7 is a flowchart showing a control as an integral-added optimal regulator in the embodiment.
Figure 8:
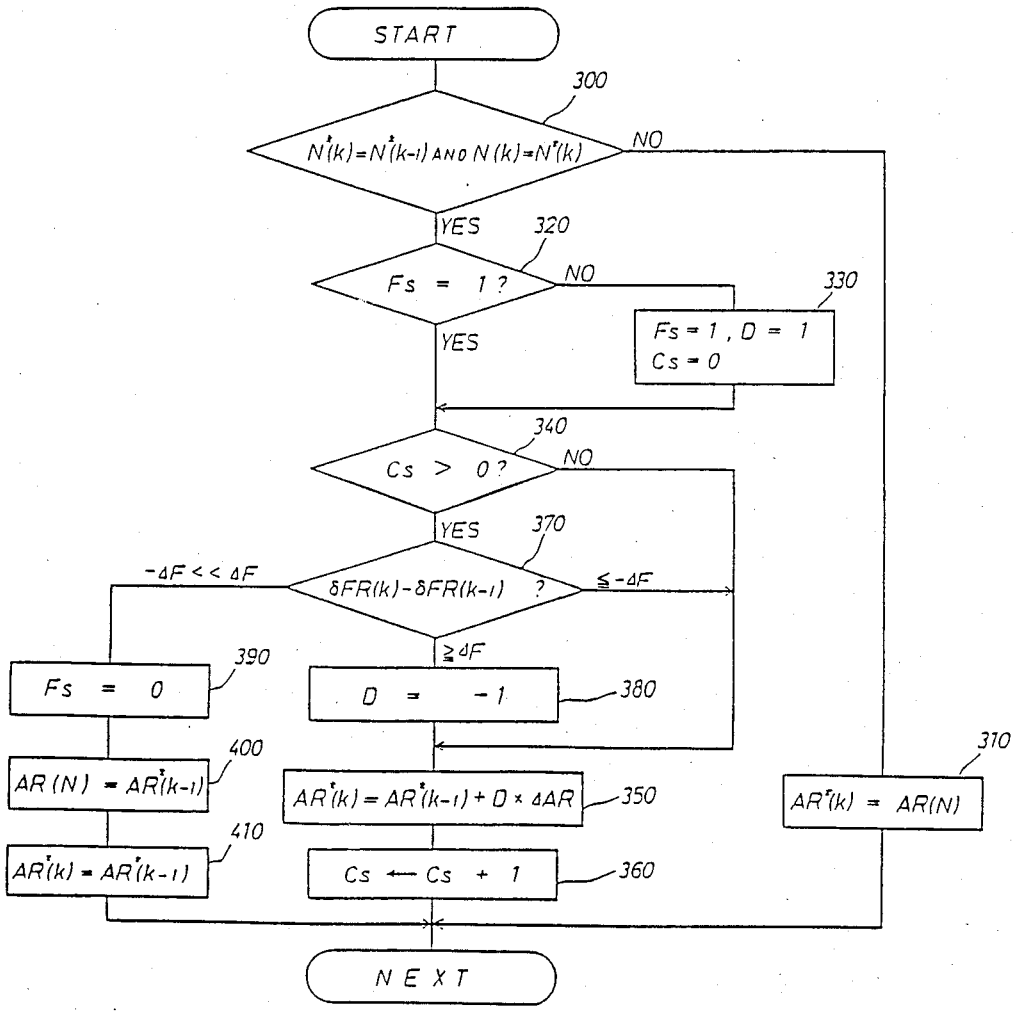
FIG. 8 is a flowchart showing a control routine for minimizing fuel cosumption amount.
Figure 9:
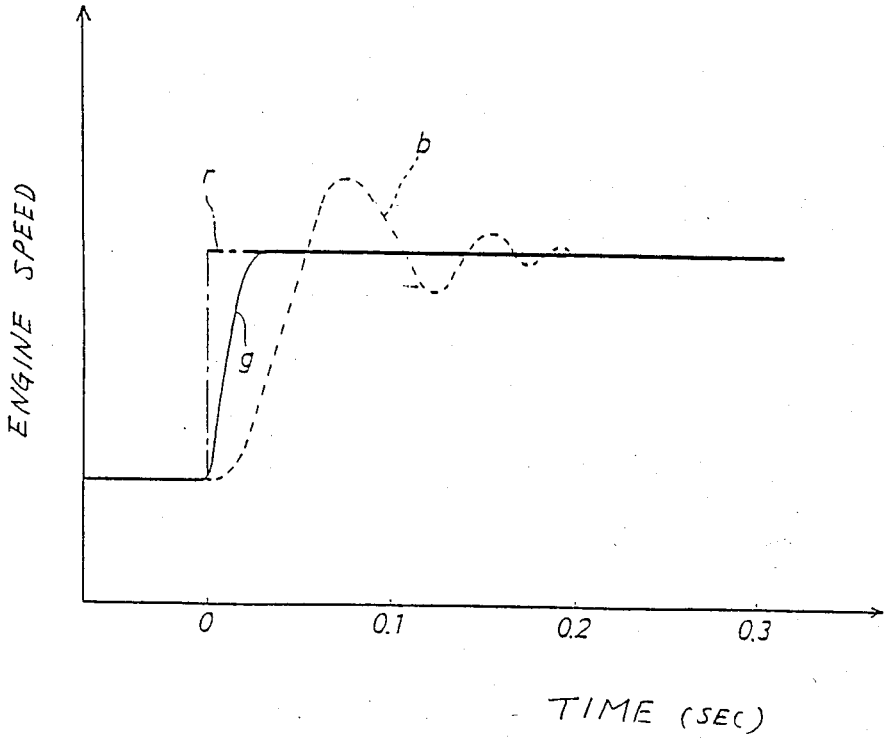
FIG. 9 is a graph for comparing the control characterisit of the present embodiment with that of a conventional control.

Embodiments of the present invention will be described with reference to drawings in detail. FIG. 3 is a schematic structural diagram showing an internal combustion engine according to an embodiment of the present invention, and its peripheral units; FIG. 4 is a control system diagram showing a control model of a system where operating state of the internal combustion engine is controlled; FIG. 5 is a block diagram for the description of system identification; FIG. 7 is a flowchart showing one example of a control executed by an electronic control circuit; FIG. 8 is a flowchart showing one example of a control for obtaining intake air quantity with which fuel compution is made minimum; and FIG. 9 is a graph for describing the effect of the present embodiment; and the description will be given in this order.

Although FIG. 3 shows a four-cylinder four cycle internal combustion engine 1 in connection with only one cylinder, there are provided, in an order from upstream portion, an unshown air cleaner, an airflow meter for mesuring intake air quantity AR, an intake air temperature sensor 5 for detecting an intake air temperature Tha, a throttle valve 7 for controlling intake air quantity, a surge tank 9, and electromagnetic fule injection valves 11. Exhaust gasses from the internal combustion engine 1 are exhausted outside from an exhaust pipe 14 via unshown exhaust gas cleaner, muffler and so on. While a comubstion chamber (cylinder) is formed of a piston 15, an intake valve 17, an exhaust valve 19, a spark plug 21 and so on, description of the operation thereof is omitted since it is well known.

In addition to these, the internal combustion engine 1 comprises a coolant temperture sensor 29 for detecting the temperature Thw of the coolant, a rotational speed sensor 32 installed in the distributor 25 for outputting a pulse signal having a frequency corresponding to the rotational speed N of the internal combustion engine 1, an a cylinder-determination sensor 33 for outputting a one-shot pulse per one revolution (720° crank angle) of the internal combustion engine 1. The opening degree of the throttle valve 7 is controlled by the throttle actuator 35 whose prime mover is a d.c. motor. In FIG. 3, the reference 37 is an accelerator opening degree sensor for detecting the stroke Acc of the accelerator 38.

In the internal combustion engine 1 and its peripheral devices having the above-mentioned structure the fuel injection amount FR, throttle valve opening degree $\theta$ and so on are controlled by an electronic control circuit 20. The electronic control circuit 40 is supplied with electrical power from a battery 43 via a key switch 41, and comprises a well known microprocessor (MPU) 44, ROM 45, RAM 46, backup RAM 47, input port 49, output port 50, and so on, where the above-mentioned respective elements and ports are interconnected via a bus 53.

The input port 49 of the electronic control circuit 40 receives signals indicative of the operating state of the internal combustion engine 1. More specifically, it comprises an unshown input unit for receiving intake air quantity AR from the airflow meter 3, intake air temperature Tha from the intake air temperature sensor 5, signals for determining whether the engine 1 is in idle state or not from the idle switch 55 and the vehicle speed sensor 56, coolant temperature Thw from the coolant temperature sensor 29, rotational speed N of the internal combustion engine 1 from the rotational speed sensor 31, cylinder-determination signal from the cylinder-determination sensor 33, and a signal for determining whether the air-conditioner is in on state or not from the air-conditioner switch 57.

On the other hand, the output port 51 outputs control signals for controlling opening degree $\theta$ of the throttle valve 7 via an actuator 35, fuel injection amount FR by opening and closing the fuel injection valves 11, and ignition timing via an igniter 24. The control by the MPU 44 of the electronic control circuit 40 will be described hereinlater in detail with reference to flowcharts of FIGS. 6 and 7.

Now, the control by the electronic control circuit 40 will be described with reference to a functional block diagram of FIG. 4, and especially, it will be described the way of vectors A, B, C of the state equation (1) and ouptut equation (2) by way of system identification and the way of obtaining observer and feedback gain F based thereon taking actual examples. FIG. 4 is a diagram showing functional blocks, and does not show hardware structure. Furthermore, the control system shown in FIG. 4 is realized by executing a series of programs shown in the flowchart of FIG. 6 in practice, and is realized as a discrete-time system.

As shown in FIG. 4, the target idle speed N* of the internal combustion engine 1 is set by the idle speed setting unit P1 using the coolant temperature Thw and the on-off state of the air-conditioner switch 57. On the other hand, a target intake air quantity AR* is determined as a value which causes minimum fuel consumption amount by a target intake air quantity setting unit P2 through a method which will be described in detail with reference to FIG. 8 hereinlater, using the target idle speed N*, actually detected intake air quantity AR, rotational speed N, and fuel injetion amount FR injected into the internal combustion engine 1. Integrators P3 and P4 are used for obtaining an accumulated value ZN(k) by accumulating the deviations SN of target idle speed N* from actual rotational speed N, and another accumulated value ZAR(k) by accumulating deviations SAR of target intake air quantity AR from actual intake air quantity AR.

The reference P5 indicates a perturbation component extracting portion which extracts a perturbation component relative to various values (ARa, Na) under the state where steady operating state in connection with intake air quantity AR and rotational speed N. This is based on the fact that the operating state of the internal combustion engine 1 is regarded as the continuance of respective steady operating states, and the dynamic model in connection with a wide range of the operation of the internal combustion engine 1 is constructed by constructing linear dynamic models around the respective steady operating states. Therefore, variables (AR, N) of the operating state of the internal combustion engine 1 are handled as a perturbation component $\delta AR(=AR-ARa)$, $\delta N(=N-Na)$ relative to a predetermined nearest operating point. The control input to the internal combustion engine 1, i.e. manipulation amounts relating to throttle opening degree $\theta$ and fuel injection amount FR, which are obtained by the above-mentioned integrators P3, P4, the observer P6 and the feedback amount determining unit P7, are also handled as perturbation components $\delta\theta$ and $\delta$FR.

The observer P6 obtains state estimated variables X (k) by estimating state variables X (k) which respresent the internal state of the internal combustion engine 1 using the perturbation components $\delta\theta$ and $\delta$FR of the condition of operation and the perturbation components $\delta$AR, and $\delta$N of the above-mentioned operating state, and the state estimated variables X (k) and the above-mentioned accumulated values ZN(k) and ZAR(k) are multiplied by the optimal feedback gain F in the feedback amount determining portion P7 so as to obtain manipulation amounts ($\delta\theta$, $\delta$FR). Since the set of the manipulation amounts ($\delta\theta$, $\delta$FR) are perturbation components relative to operating condition corresponding to steady operating state selected by the perturbation component extracting portion P5, the variables $\theta$ and FR of the control inputs to the internal combustion engine 1 are determined by adding reference setting values $\theta$a and FRa corresponding to the steady operating condition to the perturbation components by a reference setting value adding portion P8.

While the structure of the control system has briefly been described, the reason that these operating state (AR, N) and operating condition ($\theta$, FR) are used in this embodiment, is that these variables are basic values relating to the control of the internal combustion engine 1. Therefore, in this embodiment, the internal combustion engine 1 is grasped as a multivariable system of two inputs and two outputs. In addition to these, ignition timing and exhaust gas recirculation amount, for example, may be used as the amounts relating to the output of the internal combustion engine 1, and these may be taken into consideration when constructing a model of the control system. The above-mentioned model having two inputs and two outputs is used for constructing the dynamic model of the internal combustion engine 1, and in addition to these coolant temperature Thw and intake air temperature Tha of the internal combustion engine 1 are also used as factors which change the dynamic behaviour of the system. The coolant temperature Thw and so on do not change the structure of the control system but changes the state of dynamic behaviour thereof. Therefore, when the dynamic model is constructed in connection with the control system of the internal combustion engine 1, the vectors A, B, C of the state equation (1) and the output equation (2) are determined in accordance with the coolant temperature Thw and so on of the internal combustion engine 1.

Hereinabove, the hardware structure of the internal combustion engine 1 and the structure of the control system have been described taking a system of two inputs and two outputs as an example which controls the output of the internal combustion engine 1. Now it will be described about the construction of a dynamic model through actual system identification, the designing of the observer P6, and how to give the optimal feedback gain F.

First of all, a dynamic model of the internal combustion engine 1 is constructed. FIG. 5 is a diagram showing a system of the internal combustion engine 1 under steady state operation as a system having two inputs and two outputs by way of transfer functions G1(z) through G4(z). The reference z indicates z transformation of sampled values of the input/output signals, and it is assumed that G1(z) through G4(z) have appropriate order. Therefore, entire transfer function matrix G (z) is given by:

$$G(z) = \begin{pmatrix} G1(z) & G2(a) \\ G3(z) & G4(z) \end{pmatrix}$$

When there exists an interference in the input/output variables, where the system is of two inputs and two outputs as in the internal combustion engine 1 of this embodiment, it is extremely difficult to determine a physical model. In such a case, it is possible to obtain transfer function through simulation so called system identification.

The method of system identification is described in detail in "System Identification" written by Setsuo SAGARA published by Society of Instrument and Control Engineers (SICE) of Japan in 1981, and identification is performed here through least square method.

The internal combustion engine 1 is put in predetermined steady operating state, and the variation $\delta\theta$ of the throttle opening degree is made zero to add an appropriate test signal as the variation $\delta$FR of the supplied fuel amount and data of input $\delta$FR at this time and variation $\delta$N of the rotational speed as an output is sampled N times. This is expressed as input data series of $\{u(i)\}=\{\delta FRi\}$ and as output data series of $\{y(i)\}=\{\delta Ni\}$ wherein $i=1, 2, 3 \ldots N$. Here, the system can be regarded as having one input and one output, and thus the transfer function G1(z) is given by:

$$G1(z)=B(z^{-1})/A(z^{-1}) \tag{3}$$

Therefore, $$G1(z)=(b0+b1\cdot z^{-1}+\cdots +bn\cdot z^{-n})/(l+a1\cdot z^{-1}+a2\cdot z^{-2}+\ldots +an\cdot z^{-n}) \tag{4}$$

In the above, $z^{-1}$ is a unit shift operator indicating $z^{-1}\cdot x(k)=x(k-1)$.

When we determine parameters a1 to an and b0 to bn of Eq. (4) from the input and output data series $\{u(i)\}$ and $\{y(i)\}$, transfer function G1(z) can be obtained. These parameters are determined in system identification using least square method so that the following assumes a minimal value:

$$Jo = \sum_{k=n}^{N} [\{y(k) + a1 \cdot y(k-1) + \ldots + an \cdot y(k-n)\} - \{b0 \cdot u(k) + b1 \cdot u(k-1) + \ldots + bn \cdot u(k-n)\}]^2 \tag{5}$$

Figure 6:
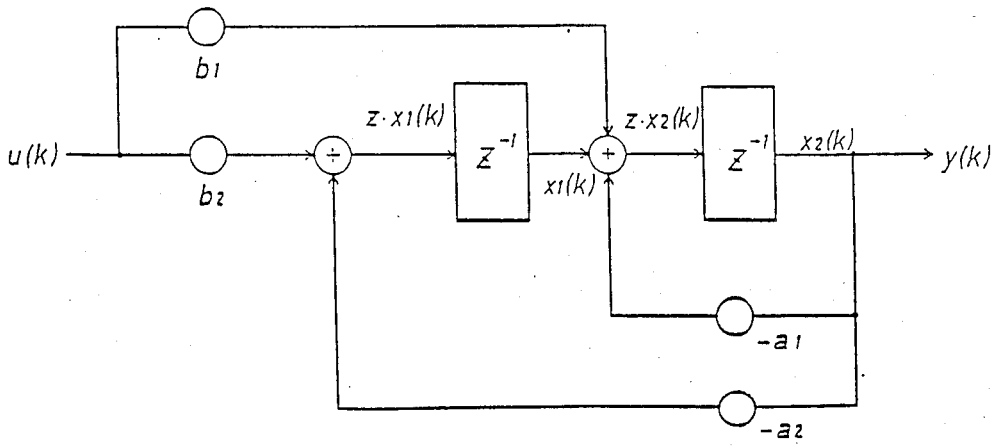
FIG. 6 is a signal flow diagram used for obtaining transfer function.

In this embodiment, respective parameters have been obtained assuming that n=2. In this case, a signal flow diagram of the system is as shown in FIG. 6, and using [X1(k)] as state variables, state and output equations thereof can be expressed by Eqs. (6) and (7):

$$\begin{pmatrix} X1(k+1) \\ X2(k+1) \end{pmatrix} = z\begin{pmatrix} X1(k) \\ X2(k) \end{pmatrix} = \begin{pmatrix} 0 & -a2 \\ 1 & -a1 \end{pmatrix}\begin{pmatrix} X1(k) \\ X2(k) \end{pmatrix} + \begin{pmatrix} b2 \\ b1 \end{pmatrix} u(k) \tag{6}$$

$$y(k) = [0\ 1]\begin{pmatrix} X1(k) \\ X2(k) \end{pmatrix} \tag{7}$$

Therefore, using system parameters A 1', B 1', C 1' for the parameters A, B, C in the case that the system is regarded as of one input and one output, we obtain:

$$A\,1' = \begin{pmatrix} 0 & -a2 \\ 1 & -a1 \end{pmatrix} \tag{8}$$

$$B\,1' = [b2\ b1]^T$$
$$C\,1' = [0\ 1]$$

In this embodiment, the following is obtained as the parameter in connection with G1(z):

$$[a1\ a2] = [-1.91\ 0.923]$$
$$[b0\ b1\ b2] = [0\ 4.86 \times 10^{-3}\ 4.73 \times 10^{-3}]$$

Through similar method transfer functions G2(z) through G4(z) as well as system parameters A 2' through A 4', B 2' through B 4', and C 2' through C 4' can be obtained. Therefore, using these system parameters, the system parameter of the original multivariable system of two inputs and two outputs, namely, vectors A, B, C of state equation (1) and output equation (2) can be determined.

In this way, the dynamic model of the present embodiment is obtained through system identification, and this dynamic model can be determined in the form that linear approximation is satisfied around a state where the internal combustion engine 1 operated under a given state. Therefore, the transfer function G1(z) through G4(z) are respectively obtained through the above method in connection with a plurality of steady operating states, and vectors A, B, C of the state equations (1) and output equations (2) are obtained where the relationship between input and output thereof is satisfied between perturbation components δ.

Now the way of designing the observer P6 will be described. While as the way of designing is known Gopinath' method, which is described in detail in "Basic System Theory" written by katsuhisa FURUTA and Akira SANO published from Corona Co. Ltd. in 1978, the observer is designed as a minimal order observer in this embodiment.

The observer P6 is used for estimating the internal state variable X (k) of the internal combustion engine 1 from the perturbation component (δθ, δFR) of the variables of the condition of operation and from perturbation components (δAR, δN) of the variables of the operating state of the internal combustion engine 1, and the reason why the state estimated variables $\hat{X}$ (k) obtained by the observer P6 can be handled as actual state variable X (k) in the control of the internal combustion engine 1 will be made clear hereinbelow. Let us assume that the output $\hat{X}$ (k) from the observer P6 is constructed as the following Eq. (9):

$$X(k)=(A-L\cdot C)\cdot X(-1)+B\cdot u(k-1)+L\cdot y(k-1) \tag{9}$$

In Eq. (9), L is a matrix arbrarily given. Modifying Eqs. (1), (2) and (9), we obtain:

$$[X(k)-X(k)]=(A-L\cdot C)[X(k-1)-X(k-1)] \tag{10}$$

Therefore, if the matrix L is selected so that an eigenvalue of the matrix ( A−L·C ) is located within a unit circle, $\hat{X}$ (k)→X (k) with k→∞, and thus it is possible to accurately estimate the internal state variable X (k) of the controlled object using series u (*), y (*), from the past, of the input control vector u (k) and the output vector y (k).

The vectors A , B , C of the state equation (1) and the output equation (2) both determined through system identification through least square method, can be similarity transformed into the following observable canonical structure considering new state variable $X$ (k)$=T^{-1}\cdot X$(k) using nonsingular matrix T because the system is observable.

$$\bar{X}(k)=\overline{A0}\cdot X(k-1)+\overline{B0}\cdot u(k-1) \tag{11}$$

$$y(k)=\overline{C0}\cdot\bar{X}(k) \tag{12}$$

In the above, $\overline{A0}=T^{-1}\cdot A\cdot T$, $\overline{B0}=T^{-1}\cdot B$, $\overline{C0}=C\cdot T$, and we obtain the following equations by selecting appropriate nonsigular T.

$$\overline{A0}=\begin{pmatrix} 0\,0\ldots & -\alpha 1 \\ 1\,0\ldots & -\alpha 2 \\ 0\,1\ldots & \cdot \\ \cdot\,\cdot & \cdot \\ \cdot\,\cdot\,\cdot & \cdot \\ \cdot\,\cdot\,\cdot & \cdot \\ 0\,0\ldots 1 & -\alpha n \end{pmatrix} \tag{13}$$

$$\overline{B0}=[\beta 1\ \beta 2\ldots\beta n]^T \tag{14}$$

$$\overline{C0}=[0\,0\ldots 1] \tag{15}$$

Then, let L matrix be replaced as $L=[-\alpha 1\ -\alpha 2\ldots -\alpha n]^T$, and we can now design a finite time settling observer as follows using equations (13), (14) and (15):

$$\overline{A0}-L\cdot\overline{C0}=\begin{pmatrix} 0\,0\ldots\ldots 0 \\ 1\,0\ldots\ldots 0 \\ 0\,1\ldots\ldots 0 \\ \cdot\,\cdot & \cdot \\ \cdot\,\cdot\,\cdot & \cdot \\ \cdot\,\cdot\,\cdot & \cdot \\ 0\,0\ldots 1 & 0 \end{pmatrix} \tag{16}$$

In the above, $\overline{A0}$, $\overline{B0}$ and $\overline{C0}$ are obtained through similarity transformation using A, B, and C, and it is also ensured that the control by the state equation is correct from this operation.

While the observer P6 has been designed using the vectors A , B and C of the state equation obtained through system identification, the output of the observer is now expressed in terms of $\hat{X}$ (k) hereinafter.

Now the way of obtaining the optimal feedback gain F will be described. Since the way of obtaining optimal feedback gain F is described in detail in the above-mentioned "Linear System Control Theory", only the results are shown here with the detail thereof being omitted.

Using $$\delta u(k)=u(k)-u(k-1) \tag{17}$$

$$\delta y(k)=y(k)-y(k-1) \tag{18}$$

in connection with the operating condition variables u (k) and operating state variables y(k), obtaining an optimal control input, i.e. operating condition u* (k), which makes the following performance index J minimal, results in solving a control problem as an integral-added optimal regulator related to the control system of the internal combustion engine 1.

$$J=\sum_{k=0}^{\infty}[y^T(k)\cdot Q\cdot y(k)+u^T(k)\cdot R\cdot u(k)] \tag{19}$$

In the above, Q and R indicate weighted parameter matrixes, and k indicates the number of sampling times which is zero at the time of beginning of control, while the right side of Eq. (19) is an expression of so called quadratic form using diagonal matrixes of Q and R .

Here, the optimal feedback gain F is given as follows:

$$F=-(R+\bar{B}^T\cdot P\cdot\bar{B})^{-1}\cdot\bar{B}^T\cdot P\cdot\bar{A} \tag{20}$$

In Eq. (20), A and B are given by:

$$\overline{A} = \begin{pmatrix} 1 & -\overline{C0}\cdot\overline{A0} \\ 0 & \overline{A0} \end{pmatrix} \quad (21)$$

$$\overline{B} = \begin{pmatrix} -\overline{C0}\cdot\overline{B0} \\ \overline{B0} \end{pmatrix} \quad (22)$$

Furthermore, P is a solution of the following Riccati equation:

$$P = \overline{A}^T\cdot P\cdot\overline{A} - \overline{A}^T\cdot P\cdot\overline{B}\cdot(\overline{B}^T\cdot P\cdot\overline{B} + R)^{-1}\cdot \overline{B}^T\cdot P\cdot\overline{A} + \begin{pmatrix} Q & 0 \\ 0 & 0 \end{pmatrix} \quad (23)$$

In the above, the performance index J in Eq. (19) has a meaning that it is intended to reduce the deviation of the operating state variables y (k), i.e. variables y (k) including at least the intake air quantity δAR, and rotational speed δN, from the target value y (k), with the variation of operating condition variables u (k)=[δθδFR] as the control inputs to the internal combustion engine 1 being regulated. The weighting of regulation of the variables u (k) of operating conditions can be altered by changing the values of the weighted parameter matrixes Q and R. Therefore, the state variables X (k) can be obtained as state estimated variables X (k) using Eq. (9) if we obtain the optimal feedback gain F using Eq. (20) by obtaining P solving Eq. (23) with arbitrarily weighted parameter matrixes Q, R being selected using the dynamic model of the internal combustion engine 1, i.e. matrixes A, B, C (which correspond to the above-mentioned $\overline{A}$, $\overline{B}$, $\overline{C}$) which is obtained in advance. Therefore, the variables u (k) of the control input operating condition for the internal combustion engine 1 can be obtained as follows:

$$u(k)=F\cdot[X1(k), X2(k) \ldots Xn(k)\ ZN(k)\ ZAR(k)]^T \quad (24)$$

By repeating simulation with the weighted parameter matrixes Q and R being altered until an optimal control characteristic is obtained, the optimal feedback gain F is obtained.

While it has been described about the construction of the dynamic models of the control system of the internal combustion engine 1 made through system identification using least square method, the designing of finite time settling observer and the computation of the optimal feedback gain F, these are obtained in advance so that actual control is performed within the electronic control unit 40 using only the results thereof.

Now, an actual control performed by the electronic control circuit 40 will be described with reference to a flowchart of FIG. 7. In the following description, an amount handled in a present processing is expressed by a subscript (k) and an amount handled in the latest cycle by another subscript (k−1).

After the internal combustion engine 1 starts operating, the MPU 44 executes repeatedly step 100 and following steps. At first in the step 100, the operating state of the internal combustion engine 1, i.e. intake air quantity AR(k−1), engine rotational speed N(k−1) and so on are read from the respective sensors.

In a following step 110, the target idle speed of the internal combustion engine 1 is computed on the basis of the coolant temperature Thw and so on, and in a step 120, the target intake air quantity AR* of the internal combustion engine 1 is computed. This target intate air quantity AR* is determined so that the amount of fuel consumed by the internal combustion engine 1 is minimum, and the computation thereof is controlled as will be described hereinlater with reference to FIG. 8. These processings correspond to respective setting portions P1 and P2 of FIG. 4.

In a step 130, the deviation SN of an actually detected idle speed N(k−1) from the target idle speed N* and the deviation SAR of actual intake air quantity AR(k−1) from the target intake air quantity AR* are obtained. In a subsequent step 140, respective deviations obtained in the step 130 are accumulated to obtain accumulated value ZN(k) using $ZN(k)=ZN(k-1)+SN(k-1)$ and another accumulated value ZAR(k) using $ZAR(k)=ZAR(k-1)+SAR(k-1)$. This processing corresponds to the integrators P3 and P4 of Fig. 4.

In a following step 150, a nearest state (which will be referred to as operating points ARa, NA) among steady-state operating states taken as satisfying linear approximation when the dynamic model of the internal combustion engine 1 is constructed, is obtained from the operating state read in step 100. In a step 160, the operating state of the internal combustion engine 1 is obtained as perturbation components (δAR, δN) relative to the steady state points (ARa, Na). This processing corresponds to the perturbation component extracting portion P5 of FIG. 4.

In a subsequent step 170, temperature Thw of the coolant of the internal combustion engine 1 is read, and since the dynamic model of the internal combustion engine 1 changes in accordance with the coolant temperature Thw, parameters A 0, B 0, L and optimal feedback gain F prepared within the observer in advance for respective coolant temperatures Thw are selected.

In a step 180, new state estimated value $\hat{X}$ (k) is obtained through the following equation (25) using $\overline{A\ 0}$, $\overline{B\ 0}$, L selected in the step 170, the perturbation components (δAR, δN) obtained in this step 160, state estimated value $\hat{X}$ (k−1)=[X1(k−1) X2(k−2) . . . X4(k−1)]$^T$ obtained in the previous cycle, the perturbation component δFR(k−1), δθ(k−1) of the fuel injection amount FR(k−1) and the throttle valve opening degree θ (k−1) both obtained in the previous cycle. This processing corresponds to the observer P6 of FIG. 4, and the observer P6 is constructed as a finite time settling observer in this embodiment as described in the above. Namely, the following computation is performed:

$$\hat{X}(k)=[\overline{A0}-L\ \overline{C0}]\hat{X}(k-1)+\overline{B0}\cdot[\delta FR(k-1), \delta\theta(k-1)]+L\cdot[\delta AR(k-1)\ \delta N(k-1)] \quad (25)$$

In a following step 190, the state estimated value X (k) obtained in the step 180, the accumulated values ZN(k), ZAR(k) obtained in step 160, the feedback gain prepared in advance and selected in the step 170 which feedback gain is given by:

$$F = \begin{pmatrix} -f11 & -f12 \ldots & -f14 & f15 & f16 \\ -f21 & -f22 \ldots & -f24 & f25 & f26 \end{pmatrix}$$

are vector multiplied to obtain perturbation components δFR(k) and δθ(k) using $[\delta FR(k)\ \delta\theta(k)]=F\cdot[\hat{X}(k)$ $ZN(k)\ ZAR(k)]^T$. This corresponds to the feedback amount determining portion P7 of FIG. 4.

In a step 200, the perturbation components δFR(k), δθ(k) of the controlled variables obtained in the step 190 are added to the respective manipulation amounts FRa, θa at the steady-state points, and manipulation amounts, i.e. operating conditions FR(k), θ(k), actually outputted to the fuel injection valves 11 and the actuator 35 of the internal combustion engine 1 are obtained.

In a following step 210, the value "k" indicative of the number of times of samplings is incremented by 1 to terminate the above-mentioned series of processings of the steps 100 through 210.

By continuously periodically performing the above-mentioned control, the electronic control unit 40 performs control using an optimal feedback gain as an integral-added optimal regulator which controls the operating state of the internal combustion engine 1 to the target idle speed N* and to the target intake air quantity AR*.

Now it will be described about a routine for obtaining the target intake air quantity AR* of the step 120. In this routine, as shown in a flowchart of FIG. 8, the target intake air quantity AR*, which makes fuel consumption amount minimum while the constant idle speed N(k) is maintained, is computed through the following steps. In the following description, the target value of the previous cycle may be expressed in terms of AR*(k−1), and the target value newly computed in the present cycle may be expressed in terms of AR*(k).

This routine starts at a step 300, and it is determined whether the target idle speed N*(k) determined in the processing of FIG. 6 is equal to the pevious cycle value N*(k−1) and whether the actual engine speed N(k) is equal to the target idle speed N*(k). In the case that one of these two equations is not satisfied, the control system has not reached equilibrium state, and therefore, it is determined that finding of intake air quantity, which makes fuel consumption amount minimum, cannot be performed, and the operational flow goes to a step 310. Then processing is performed so as to give intake air quantity AR(N), which is given from a preset map using rotational speed N of the internal combustion engine 1, as the target intake air quantity AR*(k). After this, the processing goes through NEXT to terminate this routine. Namely, turning back to the flowchart of FIG. 7 the target intake air quantity AR*(k) is determined using the map in the step 120 assuming that the internal combustion engine is in transient state.

On the other hand, when $N^*(k)=N^*(k-1)$ and $N(k)=N^*(k-1)$ in the step 300, the internal combustion engine 1 is regarded as being in equilibrium, then it is possible to search intake air quantity which makes fuel consumption amount minimum. Then the operational flow proceeds to a step 320. In this step 320, it is determined whether a flag Fs is "1" or not. Since the value of the flag Fs is 0 before searching is started, the determination results in "NO" to proceed to step 330. In step 330, the flag Fs is set to "1", regarding that the searching for intake air quantity actualizing the target idle speed N*(k) with minimum fuel consumption amount is to be started, and a coefficient indicative of searching direction, i.e. the coefficient D designating the direction of increase or decrease of the intake air quantity, is set to "1" while a counter Cs indicative of the number of times of processings is set to "0".

In a subsequent step 340, it is checked whether the value of the counter Cs has exceeded 0 or not. Since counter Cs=0 immediately after the start of searching, the operational flow goes to a step 350 to vary, i.e. increase, the target intake air quatity AR*(k) by D×ΔAR from the previous target value AR*(k−1). In a following step 360, the value of the counter Cs is incremented by 1 to terminate the present routine through NEXT.

After such searching has started, when this routine is executed, the determinations in the steps 320 and 340 both result in "YES". Then the operational flow goes to a step 370 to check how the perturbation components δFR(k) in connection with the fuel injection amount FR(k) relative to the steady-state points are changed in comparison with the perturbation components δFR(k−1) of previous cycle. When the value of δFR(k)−δFR (k−1) is less than a predetermined value −ΔF, it is regarded that the fuel injection amount can be further reduced, and the steps 350 et seq. are executed to continue searching. This indicates a situation in FIG. 5 where approaching from point "b" to point "a".

On the other hand, when the value of δFR(k)−δFR (k−1) is greater than the predetermined vlaue ΔF, it is regarded that the fuel injection amount is increasing, and the value of the searching direction flag D is set to "−1" in a step 380 so as to reverse the searching direction. Then the above-mentioned steps 350 and 360 are executed. Therefore, the target intake air quantity AR*(k) is reduced by this searching. This corresponds to searching in a direction from point "c" to point "a" in FIG. 2.

As the searching in a direction of reducing the fuel injection amount is being performed, then a point, at which the value of δFR(k)−δFR (k−1) is within a given deviation ±ΔF, will be found. This is the point corresponding to intake air quantity with which fuel consumption amount is minimum with constant target idle speed. Then, it is regarded that searching is finished, and the flag Fs is set to "0" in a step 390, and in a following step 400 target intake air quantity AR*(k−1) obtained at this time is replaced with a value of a map which determines intake air quantity from engine speed N, namely, AR(N)=AR*(k−1). In a subsequent step 410, the value of AR*(K−1) is renewed because the previously determined target intake air quantity AR (k−1) is also used in the present cycle. Then this routine is terminated through NEXT.

One searching process is completed through the above, and then searching is continued from the processing at the beginning and steps 320, 330 and 340.

As described in the above, by repeatedly executing the control routine of FIGS. 7 and 8 the apparatus for controlling operating state of an internal combustion engine according to the present invention not only controls the rotational speed of the internal combustion engine 1 to the target idle speed but also operates so as to minimize the fuel consumption amount. At this time, the system controlling the internal combustion engine 1 is an integral-added optimal regulator where the feedback gain gives optimal feedback, while the control of the throttle valve opening degree θ and the fuel injection amount FR are realized with quick response and stability which were impossible according to the conventional techniques. Accordingly, the driving feeling of the driver of the internal combustion engine 1 is not deteriorated, and it is now possible to minimize the fuel consumption amount FR by changing the throttle valve opening degree θ.

Furthermore, since the dynamic model varies in accordance with the temperature Thw of the coolant of the internal combustion engine 1, the control is performed by switching the parameters of the observer and the optimal feedback gain depending on the coolant temperature Thw and thus it is possible to provide stable control irrespective of the variation of the temperature Thw of the coolant of the internal combustion engine 1.

It is now possible to perform searching for minimizing the fuel injection amount FR of the internal combustion engine 1 because such superior response and stability have been realized for the first time. This is because although searching is possible by driving the throttle valve by the actuator through conventional feedback control, such structure could not be practically used because of poor response and low stability.

FIG. 9 shows the above through comparison, and a dot-dash line "r" indicates the target value N*(k) of the idle speed; a solid line "g" indicating an example of an engine speed obtained when the control according to the present invention is effected, a dotted line "b" indicating an example of an engine speed N(k) in the case of performing conventional feedback control. As is clear from the diaram, according to the apparatus for controlling an internal combustion engine according to the present invention which apparatus is formed as an integral-added optimal regulator, idle speed can be controlled with a response (rising) which is quicker than that according to the conventional feedback control without suffering from substantial overshoot and undershoot. Comparing time periods required until the rotational speed of the internal combustion engine 1 reaches equilibrium state, it is understood that improvement by one or more degrees of magnitude has been attained, and this makes the searching practical with which searching the fuel injection amount is minimized. Therefore, the fuel consumption amount of the internal combustion engine 1 is always controlled to be minimum when viewed macroscopically.

While in the above-mentioned embodiment, the internal combustion engine 1 is grasped as a system of two inputs and two outputs because the fuel injection amount FR and the throttle valve opening degree $\theta$ are used as the inputs and the intake air quantity AR, and the rotational speed N are used as the outputs, so as to form the integral-added optimal regulator by constructing dynamic model using system identification through least square method, it is also possible to construct dynamic model of a system considering other inputs and outputs without changing the pith of the present invention.

As described in detail hereinabove, the apparatus for controlling operating state of an internal combustion engine according to the present invention, a target intake air quantity is determined as a value which makes fuel supply amount minimum on the basis of correlation between intake air quantity and fuel supply amount when the target idle speed is made constant, and its control means is constructed as an integral-added optimal regulator which determines the amount of feedback on the basis of an optimal feedback gain predetermined according to the dynamic model of the system relating to the operation of the internal combustion engine.

Therefore, while high response and stability, which could not be obtained in the conventional internal combustion engine with a throttle actuator, are realized, the rotational speed of the internal combustion engine is controlled to a target idle speed, and there is a superior advantage that the fuel consumption amount is minimized. Accordingly, when applying to an internal combustion engine of a motor vehicle, it is possible to remarkably improve the control characteristics of the operating state of the internal combustion engine so as to provide comfortable drive feeling, while the fuel consumption by a motor vehicle is drastically reduced.

The above-described embodiments are just examples of the present invention, and therefore, it will be apparent for those skilled in the art that many modifications and variations may be made without departing from the scope of the present invention.

What is claimed is:

1. Apparatus for controlling an internal combustion engine equipped with one or more fuel injection valves, comprising:

(a) a throttle actuator for adjusting opening degree of a throttle valve disposed in an intake pipe of said engine;

(b) engine speed detecting means for producing a first signal indicative of the rotational speed of said engine;

(c) intake air quantity detecting means for producing a second signal indicative of the intake air quantity sucked by said engine; and (d) an electronic control means responsive to said first and second signals for producing and supplying fuel injection valve drive signals to said fuel injection valves and for producing and supplying throttle actuator drive signal to said throttle actuator, said electronic control means having a target idle speed setting unit, said electronic control means also having:

(i) a target intake air quantity setting unit for determining a target intake air quantity corresponding to minimum fuel amount with which the rotational speed of said engine can be maintained at said target idle speed, on the basis of fuel injection amount-intake air quantity correlation pattern which is predetermined in accord with said target idle speed; and (ii) an integral-added optimal regulator for determining feedback amounts respectively in connection with the amount of fuel to be injected and the opening degree of said throttle valve in receipt of said target idle speed and said target intake air quantity on the basis of predetermined operating formulas used for estimating the internal state of said engine which formulas are determined in accordance with a dynamic model of the system relating to the operation of said engine, and an optimal feedback gain, and for outputting said fuel injection valve drive signals and said throttle actuator drive signals which are produced acccording to said feedback amounts thus determined.

2. Apparatus for controlling operating state of an internal combustion engine as claimed in claim 1, wherein said integral-added optimal regulator comprises:

(a) a state observing unit for estimating state variables of appropriate order indicative of the dynamic internal state of the system using operating state and at least one operating condition of said internal combustion engine and using parameters predetermined on the basis of the dynamic model of the system relating to the operation of said internal combustion engine;

(b) an accumulating unit for accumulating the difference between the target intake air quantity and the detected intake air quantity as well as the difference between said target idle speed and the detected engine speed; and (c) a feedback amount determining unit for determining respective manipulation amount of said fuel injection valves and said throttle actuator using the feedback gain predetermined on the basis of the dynamic model of said system, said estimated state variables, and said accumulated value.

* * * * *